US006601347B1

(12) United States Patent
Van Den Tol

(10) Patent No.: US 6,601,347 B1
(45) Date of Patent: Aug. 5, 2003

(54) METHOD FOR MANUFACTURING A READY-TO-USE CATCH PIT

(75) Inventor: Johan Van Den Tol, Bergen Op Zoom (NL)

(73) Assignees: Waco-Liesbosch Beton B.V., Bergen Op Zoom (NL); Ubo Engineering B.V., Soesterberg (NL)

( * ) Notice: Subject to any disclaimer, the term of this patent is extended or adjusted under 35 U.S.C. 154(b) by 0 days.

(21) Appl. No.: 09/331,293

(22) PCT Filed: Nov. 12, 1997

(86) PCT No.: PCT/NL97/00618

§ 371 (c)(1),
(2), (4) Date: Aug. 20, 1999

(87) PCT Pub. No.: WO98/28498

PCT Pub. Date: Jul. 2, 1998

(30) Foreign Application Priority Data

Dec. 20, 1996 (NL) ..... 1004853

(51) Int. Cl.[7] ..... E02D 29/14

(52) U.S. Cl. ..... 52/20; 52/21; 52/169.5; 249/11

(58) Field of Search ..... 52/19, 20, 21, 52/745.17, 745.19; 249/11, 183; 285/197, 230

(56) References Cited

U.S. PATENT DOCUMENTS

| | | | | | |
|---|---|---|---|---|---|
| 3,654,952 | A | * | 4/1972 | Howe et al. | 52/20 X |
| 3,759,285 | A | * | 9/1973 | Yoakum | 137/363 |
| 3,788,080 | A | * | 1/1974 | Washabaugh et al. | 52/21 X |
| 4,406,484 | A | * | 9/1983 | Ramer | 52/21 X |
| 4,732,397 | A | * | 3/1988 | Gavin | 52/21 X |
| 5,271,193 | A | * | 12/1993 | Olsen et al. | 52/21 X |

FOREIGN PATENT DOCUMENTS

| | | |
|---|---|---|
| CH | 682504 | 9/1993 |
| DE | 2150019 | 4/1972 |
| DE | 2553388 | 6/1977 |
| DE | 4314222 | 8/1994 |
| FR | 2 674 935 | 10/1992 |

* cited by examiner

*Primary Examiner*—Beth A. Stephan
*Assistant Examiner*—Naoko Slack
(74) *Attorney, Agent, or Firm*—Jeffrey D. Myers; Rod D. Baker

(57) ABSTRACT

A method for making a catch-pit, such as the catch-pits often associated with underground pipeline junctions, manholes, or the like, where it is desirable to join a horizontal pipe with a larger-diameter, vertical, hollow, cylindrical works by means of a cottering or sleeve joint. The method includes the use of a removable profile component at the time the wall element of the pit or manhole is manufactured, to create a specially contoured opening in the wall to receive a correspondingly-shaped sleeve joint, which in turn receives the pipe.

3 Claims, 2 Drawing Sheets

METHOD FOR MANUFACTURING A READY-TO-USE CATCH PIT

The invention relates to a method of manufacturing a ready-for-use catch pit comprising a sump and a wall element placed on the sump, wherein the sump or the wall element is provided with at least a cottering or sleeve joint suitable for the connection of a sewage drain; wherein during manufacture of the catch pit, when the sump or the wall element is poured, a removable profile component is incorporated in the wall element; and wherein after the wall element is set, the profile component is removed, producing an orifice in the sump or the wall element for receiving the cottering or sleeve joint.

Such a method of manufacturing a catch pit is known from DE-A-25 53 388. The catch pit manufactured according to this citation is rectangular in shape, rendering the manufacture of the orifices that are intended to receive the cottering or sleeve joint fairly easy. The connection of the cottering or sleeve joint according to DE-A-25 53 388 is cone-shaped in order to adapt to different circumstances that may exist when connecting the catch pit to a sewage drain.

DE-A-21 50 019 also teaches a rectangularly-shaped catch pit with provisions for connecting a sewage drain according to the known art. When applying this known art in the manufacture of a catch pit having a substantially cylindrical shape, this poses severe problems which will be explained with reference to FIGS. 1(*a*)–(*i*).

The method of manufacturing a catch pit with a diameter of 1000 mm is explained by means of FIGS. 1(*a*)–((*i*), which catch pit is provided with a sleeve having a diameter of 500 mm. FIGS. 1(*a*) and (*b*) show a top view and cross-sectional side view of a wall element 1 intended for a catch pit. FIG. 1(*c*) shows the situation wherein the wall element 1 is provided with an orifice 2. In and around the orifice 2 an attachment 3, an insert piece 4, and a pipe element 5 is provided, as shown in FIGS. 1(*d*) and (*e*) in a cross-sectional side view and top view. FIGS. 1(*f*) and (*g*) once again show in cross-sectional side view and top view the assembly of the wall element 1, the attachment 3, the insert piece 4 and the pipe element 5. By way of completion and in order to connect the parts, they will be concreted in as indicated by arrow 6. After this operation the floor 7 is poured, see FIG. 1(*h*). FIG. 1(*i*) shows the ready catch pit. This known method entails difficult work conditions associated with the pouring of the floor 7, putting in the steel elements 3, 4 and 5 which are heavy of themselves, and in particular the necessity of using heavy concrete ribs to fit into the recesses between the wall element and the cottering or sleeve joint. Also the complexities of the shape of the orifice require that in the manufacturing method according to the state of the art, quite thick wall elements must be used in manufacturing the substantially cylindrical catch pit.

The object of the invention is now to provide a method for manufacturing a catch pit, which manufacturing method is greatly simplified and with which it is possible to use wall elements having much reduced thicknesses.

According to the invention, a method of manufacturing a catch pit having a substantially cylindrical shape is proposed, wherein the profile element is incorporated in the cylindrical wall element thereby following its curvature, which profile element is provided with a protrusion extending into the catch pit's interior so as to cause that after the profile element's removal, the orifice narrows in steps toward the interior, defining a sideways extending rim, and that the cottering or sleeve joint is placed onto the sideways extending rim of the orifice. This provides the advantage that instead of making suitable arrangements to the catch pit's wall as is required in the prior art, the cottering or sleeve joint may be adapted to receive differing diameters of sewage drains. The manufacturing process of the catch pit can therefore remain unchanged, which provides clear benefits over the prior art, which would require complex rearrangements in the manufacturing of the catch pit per se.

Correspondingly, the catch pit manufactured according to the invention is characterized in that the sump or the wall element is provided with an orifice which narrows in steps toward the interior, defining a sideways extending rim, and that the cottering or sleeve joint is placed onto the sideways extending rim of the orifice.

The invention will now be explained in more detail with reference to the drawing, in which FIGS. 1(*a*)–(*f*) show the method and catch pit according to the state of the art, wherein:

FIG. 1(*b*) is a cross-sectional side view;

FIG. 1(*c*) is a cross-sectional side view with a wall orifice;

FIG. 1(*d*) is a cross-sectional side view with the wall orifice and showing an attachment, insert piece, and pipe element prior to assembly;

FIG. 1(*e*) is a top view with the wall orifice and showing the attachment, insert piece, and pipe element prior to assembly;

FIG. 1(*f*) is is a cross-sectional side view with the wall orifice and showing an attachment, insert piece, and pipe element after assembly;

FIG. 1(*g*) is is a top view with the wall orifice and showing the attachment, insert piece, and pipe element after assembly;

FIG. 1(*h*)is a cross-sectional side view showing the pouring of a floor; and FIG. 1(*i*) is a cross-sectional side view of the completed catch pit; and FIGS. 2(*a*)–(*d*) show the method and catch pit according to the invention, wherein:

FIG. 2(*a*) is a top view of a wall element with a removed shrinkage core;

FIG. 2(*b*) is a cross-sectional side view of a wall element with a removed shrinkage core;

FIG. 2(*c*) is a side view of a coffering element;

FIG. 2(*d*) is a frontal view of the coffering element;

FIG. 2(*e*) is a horizontal cross-sectional view of the cottering element;

FIG. 2(*f*) is a vertical cross-sectional view of the cottering element;

FIG. 2(*g*) is a top view of the wall element and the cottering element prior to assembly;

FIG. 2(*h*) is a cross-sectional side view of the wall element and the cottering element prior to assembly; and FIG. 2(*i*) is a cross-sectional side view of the completed catch pit.

Figure 1H:
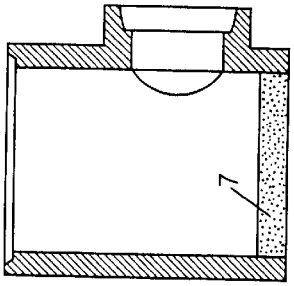
FIG 1(h) PRIOR ART
FIG. 1(*a*) is a top view.
Figure 1I:
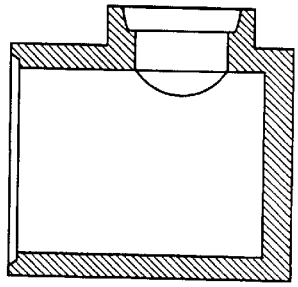
FIG 1(i) PRIOR ART
Figure 1E:
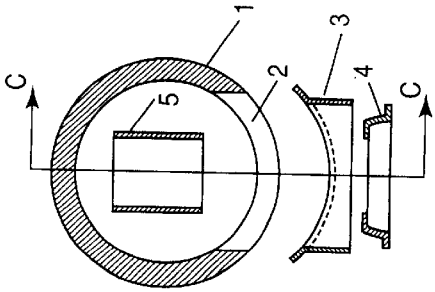
FIG 1(e) PRIOR ART
Figure 1G:
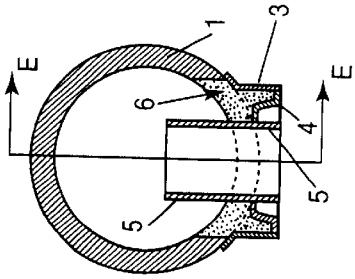
FIG 1(g) PRIOR ART
Figure 1D:
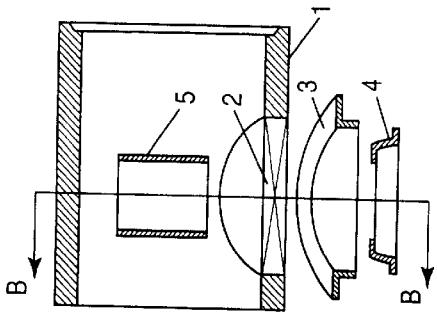
FIG 1(d) PRIOR ART
Figure 1F:
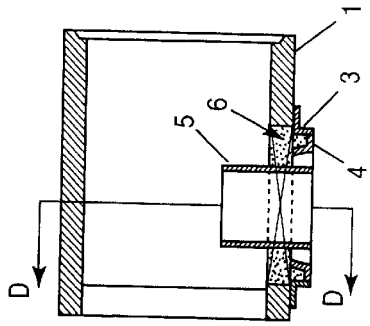
FIG 1(f) PRIOR ART
Figure 1C:
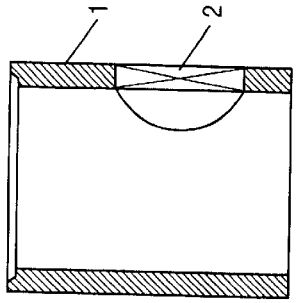
FIG 1(c) PRIOR ART
Figure 1A:
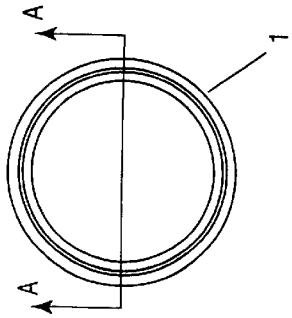
FIG 1(a) PRIOR ART
Figure 1B:
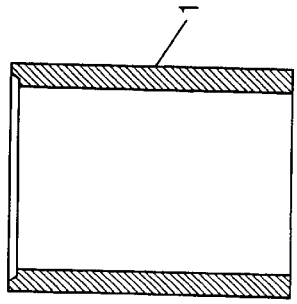
FIG 1(b) PRIOR ART

With regard to the description of the state of the art as shown in FIGS. 1(*a*)–(*i*), reference is made to the above.

Figure 2A:
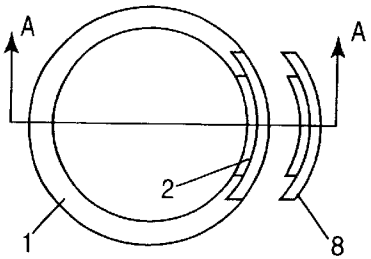
Figure 2B:
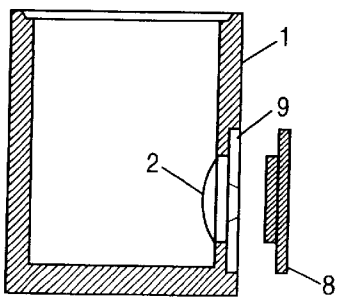
Figure 2C:
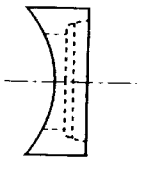
Figure 2D:
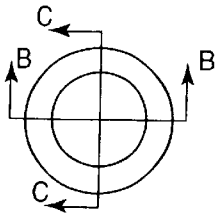
Figure 2E:
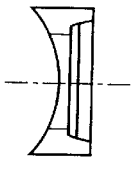
Figure 2F:
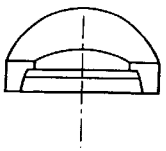
Figure 2G:
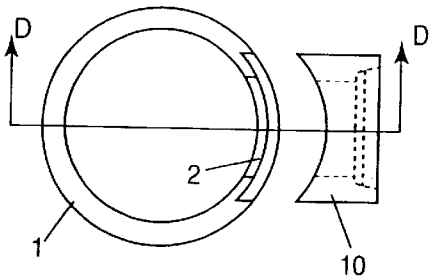
Figure 2H:
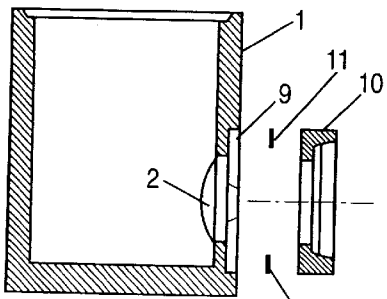
Figure 2I:
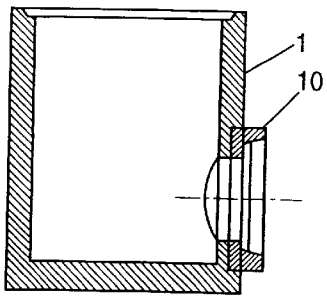

FIGS. 2(*a*)–(*i*) show under FIGS. 2(*a*) and (*b*) top and cross-sectional side views of a wall element 1 for a catch pit, in which during pouring of the wall element, a steel ring profile with shrinkage core 8 was provided, which in FIGS. 2(*a*) and (*b*) is shown in the removed state. By removing this profile element 8, an orifice 2 is created in the wall element 1. Through the form of the profile element 8, the orifice 2 is provided with a recess which narrows in steps having a sideways extending rim 9. A separate fitting piece, forming the cottering or sleeve joint, has to be attached in the orifice 2 onto the sideways extending rim 9 to provide the finished catch pit. FIGS. 2(*c*)–(*f*) show a suitable cottering element from different views, namely starting at the top left, a side view, and from there clockwise a view as intended for placing onto the sideways extending rim 9 of the wall element 1, a horizontal cross section and a vertical cross section. FIGS. 2(*g*) and (*h*) show again the wall element 1 with the orifice 2, in top view and cross-sectional side view, as well as the cottering element 10 that is to be inserted into the orifice 2. Prior to fitting the cottering element 10 into the orifice 2, a layer of adhesive 11 is provided on the sideways extended rim 9 of the orifice 2, and optionally also on the rim extending radially sideways and from the rim 9. The cottering element 10 fits into said orifice and due to the adhesive bonding the integral and ready catch pit is provided as shown in FIG. 2(*d*).

The catch pit manufactured according to the invention may be provided with a wall element 1 which is less thick than the catch pit according to the state of the art.

What is claimed is:

1. A method of manufacturing a ready-for-use catch pit having a substantially cylindrical shape, the catch pit comprising a sump and a wall element placed on the sump, the method comprising the steps of:

during manufacture of the catch pit, when the wall element is poured, incorporating a removable profile component in the wall element thereby following its curvature;

providing the wall element with an annular cottering or sleeve joint adapted to receive a sewage drain pipe, and having an end defining an arcuate profile corresponding to said curvature of said wall element; and after the wall element is set, removing the profile component, thereby producing an orifice in the wall element for receiving the cottering or sleeve joint, wherein the profile component comprises a protrusion extending into the catch pit's interior so as to cause that after the profile component's removal, the orifice narrows in steps toward the interior, defining a sideways extending rim, and wherein said end of said cottering or sleeve joint defining an arcuate profile is placed onto the sideways extending rim of the orifice.

2. A catch pit comprising a sump, a substantially cylindrical wall element placed on the sump, and suitable to receive thereon a cone provided with a manhole, wherein the wall element is provided with a recess which narrows in steps toward the interior, defining a sideways extending rim, and wherein a cottering or sleeve joint having an end defining a profile corresponding to the curvature of said wall element is placed onto the sideways extending rim of the recess.

3. A catch pit according to claim 2 wherein the cottering or sleeve joint is bonded with the sideways extending rim of the recess by means of adhesive.

* * * * *